United States Patent [19]

Åkerström et al.

[11] Patent Number: 4,627,218

[45] Date of Patent: Dec. 9, 1986

[54] METHOD OF AUTOMATICALLY BANDEROLING BUNDLED SHEET OBJECTS AND APPARATUS FOR CARRYING OUT THE METHOD

[75] Inventors: Bengt Åkerström, Lidingö ; Friedrich Hartmann, Saltsjöbaden, both of Sweden

[73] Assignee: Esselte Security Systems, Stockholm, Sweden

[21] Appl. No.: 753,810

[22] Filed: Jul. 9, 1985

Related U.S. Application Data

[63] Continuation of Ser. No. 569,153, Jan. 9, 1984, abandoned.

[51] Int. Cl.[4] ..... B65B 51/06

[52] U.S. Cl. ..... 53/399; 53/415; 53/137; 53/586

[58] Field of Search ..... 53/528, 228, 230, 540

[56] References Cited

U.S. PATENT DOCUMENTS

| | | | |
|---|---|---|---|
| 1,261,612 | 4/1918 | Powers | 53/528 |
| 2,612,737 | 10/1952 | Thielens | 53/587 X |
| 2,653,433 | 9/1953 | Sandberg | 53/228 X |
| 2,908,121 | 10/1959 | Enos | 53/415 X |
| | | Winkler | 53/586 X |
| 3,030,750 | 4/1962 | Lowe | 53/528 |
| 3,543,466 | 12/1970 | Forsberg | 53/415 |
| 3,721,601 | 3/1973 | Pituch | 156/541 |
| 3,869,845 | 3/1975 | Rodach | 53/137 |
| 4,078,363 | 3/1978 | Ranzi | 53/228 |
| 4,137,691 | 2/1979 | Takashi | 53/230 X |
| 4,162,602 | 7/1979 | Achelpohl | 53/415 |

FOREIGN PATENT DOCUMENTS

| | | | |
|---|---|---|---|
| 858192 | 1/1961 | United Kingdom | 53/586 |

*Primary Examiner*—John Sipos

*Attorney, Agent, or Firm*—Nies, Webner, Kurz & Bergert

[57] ABSTRACT

A method of automatically banderoling objects, for example banknotes, arranged in a bundle, by laying a banderole, for example a paper strip, about the bundle, preferably after the bundle was compacted, and thereafter sealing the bundle by jointing together preferably the end portions of the strip. The method is especially characterized in that the strip is jointed together by means of a self-adhesive label after the strip was folded about the bundle, which label is automatically separated from its carrier strip and attached on the strip. The invention also relates to an apparatus for carrying out the method.

13 Claims, 7 Drawing Figures

40
39
26
29
34
27
41
28
32
33
36
10
30
45
17
14
8
10
12
2
15
3
16
13
11
35
20
31
7
43
21
43
42
42
6
25
22
24
3
23
9
4
5
19
3
2
1

10
18
14
2
18
15

24
22

METHOD OF AUTOMATICALLY BANDEROLING BUNDLED SHEET OBJECTS AND APPARATUS FOR CARRYING OUT THE METHOD

This application is a continuation of application Ser. No. 569,153, filed Jan. 9, 1984, now abandoned.

BACKGROUND OF THE INVENTION

This invention relates to a method of automatically banderoling bundled sheet objects, such as banknotes, by laying a banderole, a strip, about the bundle and sealing the bundle by jointing together the banderole. The invention also relates to an apparatus for carrying out the method.

Methods of this kind are known previously. At one method, a strip provided with size on one side is laid about the bundle and fastened by means of the size or a corresponding medium. In cases when only certain portions are provided with size, there is the problem of automatically keeping account of the portions where the strip is pre-sized. A continuous layer of size requires a great amount of size, and at contact between the size and the surrounding exposed size, adjacent portions of the strip adhere to an undesired extent. In other known methods, the strip is coated with a layer, which plasticizes when being heated and is utilized as size. It is, however, a great problem to heat the layer just enough sufficiently as required for obtaining the necessary and permanent adherence.

Methods, at which the size is applied to the strip immediately before the strip is finally folded about the bundle, are less attractive from operation reliability and safety aspects.

SUMMARY OF THE INVENTION

The present invention relates to a method and an apparatus, which eliminate the aforesaid problems. The invention ensures a very high reliability in operation and renders it possible, that banderoling can be carried out in a simple and inexpensive way and with high flexibility in respect of bundle dimension and marking.

The invention, thus, relates to a method of automatically banderoling sheet objects, for example banknotes, arranged in a bundle by laying a banderole, a paper strip, about the bundle, preferably after the bundle has been compacted, and sealing the bundle by joining together, preferably, the end portions of the strip. The method is especially characterized in that the strip after having been folded about the bundle is joined together by means of a self-adhesive label, which is automatically separated from its carrier strip, which can be termed a tape and attached to the banderole strip.

The invention also relates to an apparatus for the automatic banderoling of sheet objects, for example banknotes, arranged in a bundle, by which apparatus a banderole, a paper strip, is laid about the bundle, and the bundle is sealed by joining together preferably the end portions of the strip, and which apparatus comprises means for advancing and separating a predetermined strip length.

The apparatus is especially characterized in that it comprises means for stepped feed of self-adhesive labels attached on a carrier strip, that a guide roller or corresponding member is located adjacent a path followed by said strip, which guide roller has a radius of curvature sufficiently small, that the label, starting at its leading portion in the feed direction of the carrier strip and label, separates from the carrier strip upon deflection of the carrier strip over the guide roller, and that means, for example a press roller, are provided to press the label against and thereby attach it to the banderole strip so that the label projects from an end portion of the banderole strip.

BRIEF DESCRIPTION OF THE DRAWING

The invention is described in greater detail in the following, with reference to an embodiment thereof and to the accompanying drawings, in which

In FIG. 1 the numeral 1 designates a reel with banderole strip, for example paper strip, from which reel, strip 2 is intended to be taken. The strip is intended to be advanced in a predetermined path by means of feed rollers 3, several sets being shown in the Figure. The length advanced is counted, for example by means of a stroboscopic meter disc which co-operates in known manner with a reading fork 4. For the sake of clearness, in FIG. 1 a strip is shown which is coherent through the entire apparatus. For checking, recording and controlling the apparatus, a computer or corresponding means (not shown) is provided in known manner a.o. so that the steps of the method according to the invention are carried out in the sequence desired. 6 designates a reading fork of known kind, comprising for example a photocell arrangement which, seen in the feed direction of the strip, is located before and in connection to a support roller 7 or the like, over which the strip is intended to run, and in connection to which a press roller 8 or the like is provided movably to and from the support roller 7. The reading fork 6 is capable to scan the leading end portion of the strip in the feed direction, and a delay in response to the advancing speed is provided so that the feed of the press roller 8 to the support roller 7 starts.

Figure 2:
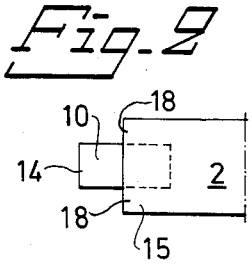
FIG. 2 shows one end of a paper strip according to the invention provided with self-adhesive label.

The numeral 9 designates a roll, a magazine, of a label strip consisting of so-called self-adhesive labels 10 which are attached on a carrier strip 11. The numeral 12 designates a feed drum or corresponding member, by which the carrier strip 11 with labels 10 is intended to be stepped ahead. The numeral 13 designates a guide roll or corresponding member, over which the carrier strip is intended to run. Said roll 13 is located adjacent the support roller 7 and, thus, adjacent the path, through which the strip 2 is intended to run. The guide roll 13 has a radius of curvature sufficiently small, that a label, beginning at its leading portion 14 in the feed direction of the carrier strip and label, separates from the carrier strip when the carrier strip is being deflected over the guide roll. The label, separated at least at its leading portion 14, is intended by the press roller 8 to be pressed against and thereby be attached to the strip 2 so as to project from said leading end portion 15 or end portion 15 of the strip 2 as shown in FIG. 2.

The numerals 16,17 designate two reading forks, for example photocell arrangements, which are located one after the other and after the support roller 7 along the path of the strip for controlling that a label is attached on the strip. One fork is capable to scan the leading portion 14 of the label, and the second fork scans the portions 18 (FIG. 2) of the leading portion 15 of the strip projecting to the side of the label.

Preferably in relatively close connection to the reel 1, a pair of scissors 19 or corresponding device is located for cutting off the strip 2 after a predetermined calculated length of strip has been advanced and the advancing movements has stopped.

The measuring forks 16,17 are intended also to scan the trailing end of the strip. When the trailing end has been scanned, the feed is intended to stop, possibly with a certain delay.

Figure 1:
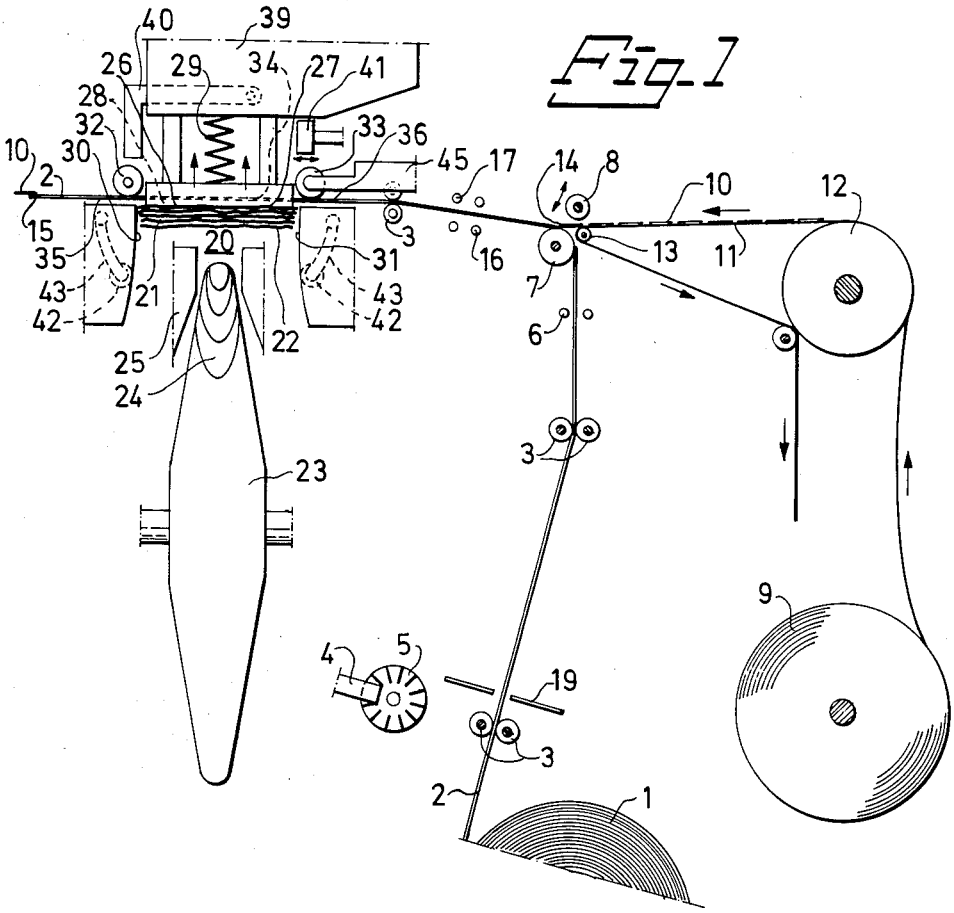
FIG. 1 shows in principle and schematically a view from the top of an apparatus according to the invention, seen in parallel with the plane of the top edge of the bundled objects to be banderoled.
Figure 3:
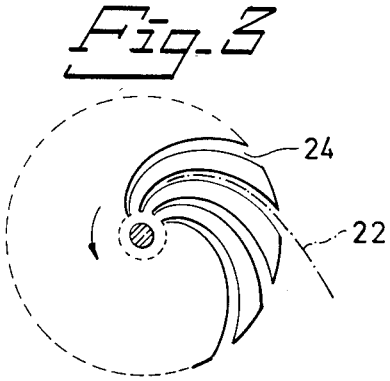
FIG. 3 shows schematically a wheel provided with spokes for arranging objects, banknotes, in bundles.

The numeral 20 designates a so called shaft-formed space a work space, in which a bundle 21 of sheet objects 22 is intended to be built up by the supply of objects by expedient means, which according to the embodiment shown are a wheel 23, the periphery of which projects into the space 20, and which is provided with spokes 24, FIGS. 1 and 3, which have spiral shape and are spread in axial direction of the wheel and deflected against the rotation direction of the wheel. Between said spokes 24 objects 22 are intended to be fed by devices (not shown). The numeral 25 designates wiping members, between which ths wheel is located, and by which objects are removed from the wheel, which objects are thereby fed into the space 20.

The numeral 26 is a bottom member or corresponding part of the laterally situated work space 20, which for convenience is called shaft 20, against which the bundle 21 is intended to be built up, and along which the strip 2 with labels 10 is intended to be inserted behind the object 27 supplied first, preferably passing along a groove 28 or the like extending along the front face of the bottom member. The space 20 also is defined by a lower horizontal support structure or the like (not shown), which is substantially in parallel with the plane of FIG. 1.

Figure 4:
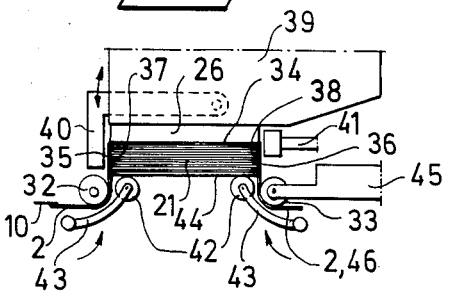
FIG. 4 shows a portion of the apparatus according to FIG. 1, in which portion bundling and banderoling is effected, and which portion is shown in a phase of bundle compacting.

The bottom member 26 is capable, against a spring force marked by a spring 29 during the supply of objects 22 to be moved substantially perpendicularly to the plane of the objects and in the same direction, in which the objects are supplied to the space 20, between and past at least two rollers 32, 33 or the like, which are located substantially adjacent two opposed sides 30, 31 of the shaft 20, and the axial direction of which rollers 32,33 is substantially in parallel with the plane of the objects, and by which rollers the portions 35,36 of the strip 2 which are located outside the objects and connected to the portion 34 of the strip 2 located in the groove 28 between bottom 26 and the objects are intended to be folded in the direction from said bottom 26 and upward along two opposed sides 37,38 of the bundle 21, which sides are perpendicular to said bottom 26, as shown in FIG. 4 where for the sake of clearance some details have been omitted.

In FIG. 4 bottom 26 is in a rear position in connection to a support wall 39 or corresponding detail. The bundle 21 has partially passed a stop dog 40 or the like, which is located in connection to the side 37 and can be folded to and from the bundle, and also a stop member 41, which is located in connection to the side 38 and can be moved in the direction to and from the side 38 for adjustment to different bundle widths. By means of the dog 40 and member 41 a sharp folding of the strip 2 in connection to bottom 26 is obtained.

In connection to each of the sides 30,31 of the shaft 20, at least one arm 43 or the like preferably provided with an end roller 42 is located. The arm 43 is pivotal between a first position, FIG. 1, where the passage to the space 20 is held open, and a second position, FIG. 4, where the end roller 42 abuts the object 44 supplied last. By means of arms 43, bottom 26 is intended to be moved to a rearward position at the same time as the bundle 21 is compacted. Preferably two arms 43 are located at each side 37,38, one upper and one lower arm.

Figure 5:
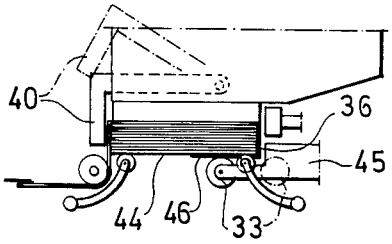
FIG. 5 shows the portion according to FIG. 4 in a phase, in which the label-free end portion of the strip has been folded inward over the upper surface of a bundle, before the strip, the banderole. is joined together.
Figure 7:
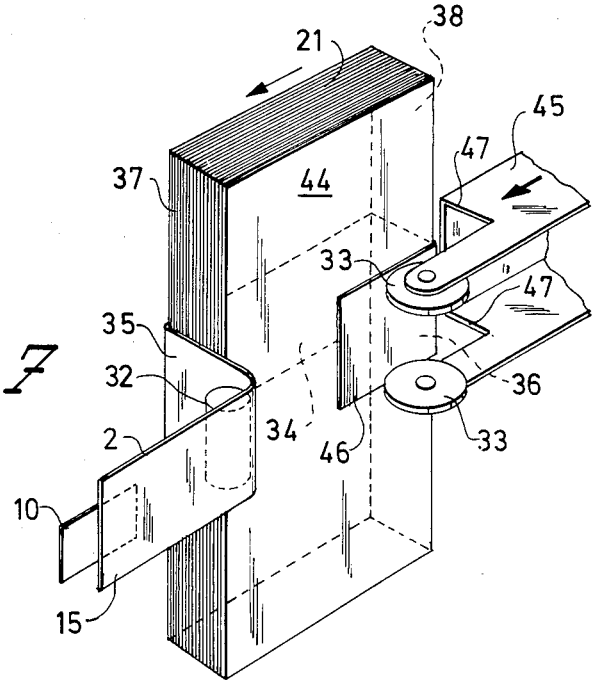
FIG. 7 is a schematic perspective view of the bundle and parts of the portion according to FIGS. 4–6 in a phase corresponding substantially to that shown in FIG. 5.

One 33 of said rollers which, however, preferably consists of two rollers 33 in spaced relationship of each other as in FIG. 7 and located in connection to a first 38 of the bundle sides 37,38 perpendicular to bottom 26, is located on an arm 45, which substantially is in parallel with the plane of bottom 26 and objects, by means of which roller(s) 33 the label-free end portion 46 of the strip connected to portion 36 of the strip 2 located adjacent the first bundle side 38 is intended to be moved inward over and be held pressed against the object 44 supplied last, as shown in FIG. 5.

Figure 6:
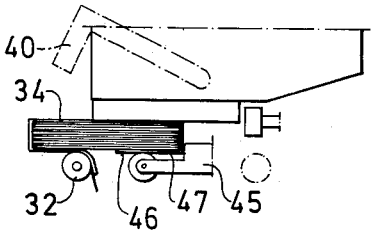
FIG. 6 shows the portion according to FIGS. 4 and 5 in a phase when the strip end portion provided with label has been moved inward over the upper surface of the bundle, before the label is finally attached on the label-free end portion of the strip.

The arm 45 or corresponding member comprises a supporting portion or the like, FIGS. 6 and 7, which is intended to abut the first side 38, and by which upon movement of the arm 45 the bundle is intended to be moved substantially in parallel with the plane of the objects and at least partially past the roller 32 located in connection to the second one 37 of the sides 37,38, whereby the end 15 of the strip 2 provided with label and connecting to the second one 37 of the sides 37,38 is intended to be moved inward over the object 44 supplied last by means of the roller 32, and whereby by means of the roller 32 the label is intended to be pressed against the label-free end portion 46. The dog 40 hereby assumes the position according to FIG. 6. The device preferably is adjusted so that the arm 45 with the rollers 33 can pass between the upper and the lower arm 43 and so, that the rollers 33 can pass past the roller 32.

The mode of operation of the apparatus and the method according to the invention substantially should have become apparent from the aforesaid. The strip 2, thus, is advanced, and each advanced length is counted, by means of the feed rollers 3 and is stopped with the leading end 15 in connection to the rollers 7,8 after the leading end has been detected by the reading fork 6. Thereafter paper strip 2 is advanced up adjacent roller 7 (FIG. 1), and carrier strip 11 and a label 10 simultaneously advanced over the roll 13, whereby the label loosens and is pressed firmly by the roller 8 onto the leading end of the paper strip 2, resulting in the arrangement of label 10 and leading strip end 15 as shown in FIG. 2. Thereafter the feed continues. The attachment of a label is checked by the reading forks 16,17, and when the desired predetermined strip length has been advanced, the feed is stopped and the the strip is cut off by the shears 19. Thereafter the strip 2 is advanced additionally, whereby the end 15 passes into the groove 28 behind the first object 27 and runs out past the roller 32. The trailing end is detected by the forks 16,17, whereafter the feed is stopped. Feed rollers 3 engaging the strip 2 are parted and while objects, banknotes, are being filled into the shaft 20, the shaft bottom member 26 is moved in the direction toward the supporting wall 39, at the same time as the portions of the strip 2 located outside the objects and said bottom 26 are pulled by the rollers 32,33 and folded forward along the bundle sides 37,38. By means of a counting mechanism (not shown) counting the objects supplied to the wheel 23 is detected when the desired predetermined number of objects have been supplied to the shaft 20. The supply then stops, and the arms 43 with the end rollers 42 are moved ahead and compact the bundle and press the bottom member 26 of the shaft to a bottom position whereby the phase of joining the strip ends together and ejection is initiated. Hereby first the arm 45 is moved over the bundle whereby the label-free strip end 46 is moved inward, over the object 44 supplied last, by means of the rollers 33 shifting to the left to the position as seen in FIGS. 5 and 7. Thereafter the supporting portion 47 of arm 45 co-operates with the bundle side 38 so that the bundle is moved by further shifting of arm 45 to the left (FIG. 6) past the roller 32 whereby the banderole strip end 15 provided with an adhered label is folded inward over the left end of the bundle and the label 10 is pressed by roller 32 onto the label-free end portion of strip 2. Thereafter the banderoled bundle is advanced for co-operation with additional means for transport etc. (not shown).

As should have become apparent from the aforesaid, the method and apparatus render possible automatic banderoling without the disadvantages involved with known methods. Self-adhesive labels available are utilized for jointing together the banderoles, whereby problems with heating, size handling and the like are avoided. The apparatus can be completed simply with equipment (not shown) of known kind for automatically marking the labels, for example, with desired characteristics for the bundles. The method and apparatus also offer high reliability in operation. Owing to the fact that, among other things, the stop member 41 and arm 45 can be moved, and the strip length advanced can be recorded, the apparatus simply can be adjusted and adapted for different strip widths, and banknote dimensions.

The invention has been described above with reference substantially to one embodiment. Of course, several variants and minor alterations can be imaged without abandoning the invention idea. The label, for example, can be attached, with obvious alterations, on the trailing end of the strip 2. The advanced strip length, furthermore, can be scanned in different ways. If required, of course, more rollers 32,33 and arms 45 can be imagined.

The invention, thus, must not be regarded restricted to embodiments set forth above, but can be varied within the scope defined in the attached claims.

We claim:

1. A method of automatically banderoling sheet objects, such as banknotes, arranged in a bundle, by laying a banderole strip, such as a paper strip, about the bundle, and thereafter sealing the bundle by joining together the end portions of the strip, comprising: advancing a desired length of said strip with one strip end leading in the direction of movement toward a receiving position at the base of a structure by which a plurality of sheet objects are assembled and placed as a bundle with the face of the first one sheet object against the mid-portion of the strip with end portions of the strip extending from both sides of the bundle location; separating said desired length of strip from a supply means to form a strip trailing end; attaching one portion of a small self-adhesive label to and extending forwardly from the leading end of said strip, so that the second portion of the label projects forward from said leading strip end portion, prior to its being advanced to said receiving position; continuing to feed said separated desired length of strip, with the attached label on the strip leading end, in said direction into said receiving position, said leading end of said separated strip being an overlying end portion in a strip folding operation, the other, trailing, end portion of said separated strip being an underlying end portion in said strip folding operation; said strip folding operation comprising engaging and folding the end portions of said strip past and against the opposed side ends of the bundle of sheet objects at said receiving position; then further folding the strip trailing end portion, which will become the underlying end portion, over and flat against the face of the final sheet object in the bundle; folding the strip leading end portion, which will become the overlying end portion, the end with the label attached, over and flat against the same face of the final sheet object so that the two ends of the strip are juxtaposed and the projected portion of the label overlaps the underlying trailing end portion of said strip; and pressing the projected second portion of the label into adhered condition to said underlying trailing end portion of the strip, thereby sealing the strip around the bundle of sheet objects.

2. A method as defined in claim 1 further comprising: separating a label from a label carrier tape by moving the carrier tape over a guide roll with so small a curvature radius, that the label, beginning at its leading portion on the carrier tape separates from the carrier tape; the banderole strip (2) in its advancing movement is moving on a path adjacent said guide roll; and causing the path of the moving label, as it is being separated from the carrier strip, and the path of the leading end portion of the strip to accomplish a meeting and following in a common path with the projected portion of the label being ahead of the leading end of the paper strip; and pressing the said one portion of the label into adhered attachment to the strip leading end.

3. A method as defined in claim 1, wherein the bundle is built up by the supply of sheet objects to a shaft-like work space at the base of which said strip had been advanced so its end portions extend from opposite sides of the work space and will be disposed behind the bundle of sheet objects being built up; the bundle and the base with the intermediate part of the strip in said receiving position are moved in a direction from the bundle toward the strip; during movement of said bundle the end portions of said strip which extend beyond the bundle engage respective abutment means at each side of the base and are thereby folded perpendicular to the plane of the intermediate portion of the strip away from the base of the work-space to a position against the opposite sides of the bundle and projected past the front of the bundle; and maintaining the bundle compacted by pressure applied against the front of the bundle while the bundle and the base of the work-space are being moved in the direction causing said perpendicular folding of the two end portions of the paper strip.

4. A method as defined in claim 3, wherein; the label-free end portion of the strip folded against a first one of said bundle sides perpendicular to said bottom is further folded inward over the bundle front face by the associated one of said abutment means which that strip end portion had engaged; further folding the end portion of the strip provided with a label inward over the front face of the bundle of objects by means of the other abutment means, said last named further folding step is caused by moving the bundle of objects substantially parallel with the plane of the sheet objects past the other abutment means; the length of the strip being predetermined so that the projected portion of the label during said last named further folding step is moved to overlap and is pressed onto said label-free end portion of the strip by the movement of the bundle past the said other abutment means.

5. A method as defined in claim 1, including the step of marking predetermined characteristics, on the label.

6. An apparatus for automatically banderoling sheet objects, such as banknotes, arranged in a bundle, by laying a banderole strip, such as a paper strip, about the bundle and sealing the bundle by joining together the end portions of the strip, comprising: a folding station for receiving said objects and said strip, means for advancing and separating a predetermined length of banderole strip from a supply source of said strip; means enabling stepped feed of self-adhesive labels attached on an elongate carrier tape; a guide roll located upstream of the folding station and adjacent a path along which said carrier tape is advanced, said guide roll having a radius of curvature which, as the tape advances around the guide roll, causes a label, beginning at its leading portion in the feed direction of the carrier tape and attached labels, to separate from the carrier tape; means comprising a pressure device for engaging the separating label and causing its trailing portion to be pressed against and thereby attached to the leading end of the length of strip so as to project from said leading end portion of the strip; and means for folding the length of strip around a bundle of sheet objects and causing the label on the leading end of the strip to press against and adhere to the other, trailing, end portion of said length of strip to seal the length of strip around the bundle.

7. An apparatus as defined in claim 6, comprising a shaft-like work-space, with a shiftable planar bottom member, in which said bundle is intended to be built up by the supply of objects thereinto; means adjacent said work-space to advance said strip along the bottom member of said work-space to a receiving location which will be behind the sheet object supplied first; means for moving said bottom member substantially perpendicularly to the plane of the sheet objects, the same direction as sheet objects are supplied to the work-space; at least two spaced apart roller means, with strip folding rollers, mounted adjacent two opposed sides of the shaft, the axes of said rollers being substantially parallel with said bottom member and the plane of the bundled sheet objects; said rollers being engaged by end portions of said strip located to each side of the bundled sheet objects; said strip end portion being folded forward along two opposed sides of the bundle of sheet objects, by movement of the bundle, the work-space bottom member and the strip so that the end portions engage the rollers causing the end portions of the strip to be deflected to positions normal to the intermediate portion of the strip be and folded to positions between the rollers and the edges of the bundle of sheet objects.

8. An apparatus as defined in claim 6, comprising at least two arms provided with pressure abutment means, said arms being mounted and adapted to be moved against the sheet object supplied last and thereby compacting the bundle of sheet objects before the strip is folded about the bundle.

9. An apparatus as defined in claim 8 wherein said pressure abutment means are end rollers mounted on the ends of said arms and said arms are pivotally mounted on said means for folding said strip.

10. An apparatus as defined in claim 21, wherein one of said roller means is located adjacent to a first one of said bundle sides and includes a shiftable means with an arm carrying its associate roller, mounted for shifting movement substantially parallel with the planar arrangement of said bottom member and the bundle of objects, said one roller means thereby forcing the label-free end portion of the strip located adjacent said first one of said bundle sides inward, over and held pressed against the sheet object supplied last to the bundle; and shiftable means comprising a flat abutment portion adapted to abut said first one of the bundle sides, whereby upon movement of the shiftable means, the bundle will be moved substantially in parallel with the planar arrangement of the objects past the other roller located adjacent the second of the sides of the bundle, forcing the end portion of the strip provided with a label against the other roller and to move inward over the bundle of objects, said other roller pressing the label onto said label-free end portion of the strip.

11. An apparatus as defined in claim 7, including a sheet object transport device for supplying objects to said work-space shaft, said device comprising a wheel which projects with its periphery into said work-space shaft, and having spokes on its periphery which are spiral-shaped and spread in the axial direction of the wheel and deflected against the rotation direction of the wheel, between which spokes sheet objects are intended to be inserted, and further including wiping members provided adjacent the wheel periphery for removing sheet objects out of the wheel, whereby objects are fed into the shaft.

12. An apparatus as defined in claim 9, further comprising means supporting said roller means for varying the distance between the folding rollers whereby the apparatus can be adjusted for varying object size; said roller means supporting means being adjustably movable substantially parallel with the planar arrangement of the bottom member.

13. An apparatus as defined in claim 7, wherein said bottom member has formed in its face engaged by the received sheet object, a lateral recessed groove between its side edges along which said strip passes as it is advanced along the bottom member of said work space.

* * * * *

UNITED STATES PATENT AND TRADEMARK OFFICE

CERTIFICATE OF CORRECTION

PATENT NO. : 4,627,218

DATED : December 9, 1986

INVENTOR(S) : BENGT AKERSTROM & FRIEDRICH HARTMANN

It is certified that error appears in the above-identified patent and that said Letters Patent is hereby corrected as shown below:

On the cover sheet, left hand column, the Winkler patent should be identified as No. --3,000,151 9/1961--.

Column 8, line 18, "21" should read --7--.

Column 8, line 51, "9" should read --7--.

Signed and Sealed this

Seventeenth Day of March, 1987

*Attest:*

DONALD J. QUIGG

*Attesting Officer*

*Commissioner of Patents and Trademarks*